US007873313B2

(12) United States Patent
Nou et al.

(10) Patent No.: US 7,873,313 B2
(45) Date of Patent: Jan. 18, 2011

(54) IMAGE FORMING APPARATUS, IMAGE FORMING CONTROL METHOD, AND RECORDING MEDIUM RECORDING IMAGE FORMING CONTROL PROGRAM

(75) Inventors: Hiroshi Nou, Kanagawa (JP); Akira Iwaishi, Kanagawa (JP); Mitsuhiro Mori, Kanagawa (JP); Kunihiko Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 208 days.

(21) Appl. No.: 12/169,008

(22) Filed: Jul. 8, 2008

(65) Prior Publication Data

US 2009/0097889 A1 Apr. 16, 2009

(30) Foreign Application Priority Data

Oct. 15, 2007 (JP) ..... 2007-268038

(51) Int. Cl.
*G03G 15/20* (2006.01)

(52) U.S. Cl. ..... 399/321; 399/336

(58) Field of Classification Search ..... 399/67, 399/122, 320, 321, 335, 336; 219/216
See application file for complete search history.

(56) References Cited

U.S. PATENT DOCUMENTS 5,987,274 A * 11/1999 Satoh ..... 399/69
6,453,145 B1 * 9/2002 Miura ..... 399/336
7,254,363 B2 * 8/2007 Nakamura et al. ..... 399/336

FOREIGN PATENT DOCUMENTS

JP 2002-174924 A 6/2002
JP 2006-091552 A 4/2006

OTHER PUBLICATIONS

Japanese Office Action for JP Appln. No. 2007-268038 dated Dec. 22, 2009 and English-language translation.

* cited by examiner

*Primary Examiner*—Hoan Tran
(74) *Attorney, Agent, or Firm*—Sughrue Mion, PLLC

(57) ABSTRACT

An image forming apparatus that includes an image forming component, a flash fixing component and a control component is provided. The image forming component forms toner images using at least two toners respectively having different colors and transfers the formed toner images onto a recording medium. The flash fixing component emits a flash light onto the recording medium onto which the toner images have been transferred by the image forming component and fixes the toner images. The control component that controls the image forming component to form the toner images so that, among the toner images, a second color toner is adhered to a surface of a toner layer formed by a first toner color at a region at which the toner layer formed by the first toner color is formed, the absorbance of the second color toner being lower than that of the first color toner.

15 Claims, 8 Drawing Sheets

IMAGE FORMING APPARATUS, IMAGE FORMING CONTROL METHOD, AND RECORDING MEDIUM RECORDING IMAGE FORMING CONTROL PROGRAM

CROSS-REFERENCE TO RELATED APPLICATIONS

This application is based on and claims priority under 35 USC 119 from Japanese Patent Application No. 2007-268038 filed Oct. 15, 2007.

BACKGROUND

1. Technical Field

The present invention relates to an image forming apparatus, an image forming control method, and a recording medium recording an image forming control program. More specifically, the invention relates to an image forming apparatus transferring toner images formed using toners of two or more colors onto a recording medium, irradiating a flash light on the recording medium, and fixing the toner images, an image forming control method applicable to the image forming apparatus, and an image forming control program for realizing the image forming control method by a computer included in or connected to the image forming apparatus.

2. Related Art

Generally, it is difficult to prevent occurrence of quality degradation in a region in which a certain toner layer is formed by a toner higher in absorbance out of the toner images formed by toners of two colors or more if the toner images are to be fixed by irradiating a flash light onto a recording medium on which the toner images are transferred without making an apparatus large in size or complicating a configuration of the apparatus.

SUMMARY

According to an aspect of the invention, there is provided an image forming apparatus. The image forming apparatus includes: an image forming component that forms toner images using at least two toners respectively having different colors and transfers the formed toner images onto a recording medium; a flash fixing component that emits a flash light onto the recording medium onto which the toner images have been transferred by the image forming component and fixes the toner images; and a control component that controls the image forming component to form the toner images so that, among the toner images, a second color toner is adhered to a surface of a toner layer formed by a first toner color at a region at which the toner layer formed by the first toner color is formed, the absorbance of the second color toner being lower than that of the first color toner.

BRIEF DESCRIPTION OF THE DRAWINGS

An exemplary embodiment of the present invention will be described in detail based on the following figures, wherein.

DETAILED DESCRIPTION

Figure 1:
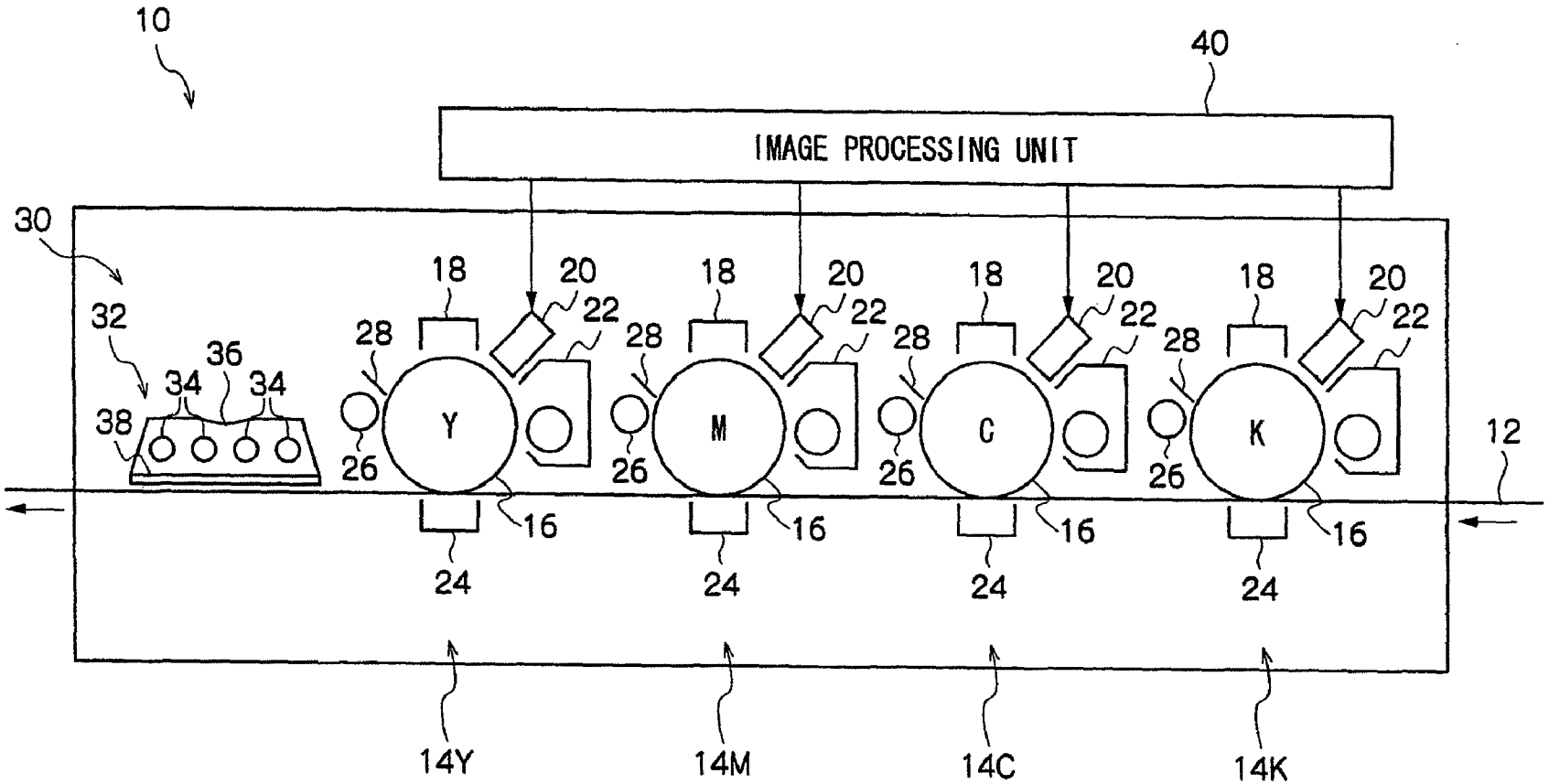
FIG. 1 is a schematic configuration diagram of an image forming apparatus according to an exemplary embodiment of the invention.

An exemplary embodiment of the present invention will be described hereinafter in detail with reference to the accompanying drawings. FIG. 1 shows a color image forming apparatus 10 according to the exemplary embodiment of the invention. The color image forming apparatus 10 is an apparatus for forming a color image on a recording medium 12 constituted by continuous sheets and corresponds to an image forming apparatus according to the invention. A recording medium 12 inserted into a main body of the color image forming apparatus 10 is transported on a transport path formed across an interior of the main body at a constant speed. Image forming units 12K, 14C, 14M, and 14Y forming toner images of K(black), C(cyan), M(magenta), Y(yellow), respectively are arranged below the transport path of the recording medium 12 in order of K, C, M, and Y from upstream of the transport direction of the recording medium 12 almost equally spaced along the transport path. The image forming units 14K, 14C, 14M, and 14Y correspond to image forming components according to the invention.

The image forming units 14K, 14C, 14M, and 14Y are identical in configuration except for the colors of the toner images to be formed. Each of the image forming units 14K, 14C, 14M, and 14Y includes a photosensitive drum 16 arranged to be orthogonal to a transport direction of the recording medium 12. Around the photosensitive drum 16, a charger 18 charging the photosensitive drum 16, an exposure unit 20 irradiating the charged photosensitive drum 16 with an exposure light modulated according to an image to be formed and forming an electrostatic latent image, a developing unit 22 supplying the toner of the predetermined color to an electrostatic latent image forming region on the photosensitive drum 16 and developing the electrostatic latent image, thereby forming a toner image of the predetermined color on the photosensitive drum 16, a transfer unit 24 arranged to be opposed to the photosensitive drum 16 across the transport path of the recording medium 12, a neutralization unit 26 removing electricity of the photosensitive drum 16, and a cleaner 28 removing residual toner on the photosensitive drum 16 are arranged.

The exposure unit 20 is connected to an image processing unit 40 configured to include a CPU, a memory, a nonvolatile storage unit such as an HDD (Hard Disk Drive) or a flash memory. Image data indicating an image to be formed is supplied from the image processing unit 40 to the exposure unit 20, and an exposure light source is turned on or off based on the supplied image data, whereby the exposure unit 20 modulates an exposure light emitted from the exposure light source according to the image to be formed. An LED is preferably used as the exposure light source. Many LEDs are arranged in a width direction of the recording medium 12 and the LEDs are simultaneously controlled to be turned on or off, thereby making it possible to perform exposure (formation of an electrostatic latent image) corresponding to one line of the image to be formed simultaneously. Alternatively, the exposure unit 20 may be configured to use LDs (laser diodes) as the exposure light source, sequentially modulate laser lights emitted from the LDs, and scan the image data in a width direction of the recording medium 12, thereby exposing the image.

The image forming units 14Y, 14C, 14M, and 14Y form toner images of different colors on circumferences of the photosensitive drums 16 using the charging units 18, the exposure units 20, and the developing units 22, and then transfer the toner images thus formed onto the recording medium 12 using the transfer units 24, respectively. Execution timings of a series of processes of charging, exposure (electrostatic latent image formation), developing (toner image formation), and transferring are controlled so that the toner images formed by the respective image forming units 14K, 14C 14M, and 14Y are overlapped on the recording medium 12. Thereby, a full-color toner image is formed on the recording medium 12.

A fixing unit 30 is arranged downstream of the transport direction of the recording medium 12 with respect to the image forming unit 14Y. The fixing unit 30 includes a flash fixing unit 32 arranged above the transport path of the recording medium 12. The flash fixing unit 32 includes four flash lamps 34 emitting a flash light for supplying energy for fixing the toner image transferred onto the recording medium 12 (melting the toner). The number of flash lamps 34 of the flash fixing unit 32 is not limited to four but can be appropriately increased or decreased. The number of the flash fixing unit 32 is not limited to one and a plurality of flash fixing units 32 can be provided. Each of the flash lamps 34 is arranged so that a longitudinal direction of the flash lamp 34 is along the width direction of the recording medium 12 (direction orthogonal to the transport direction of the recording medium 12). The flash lamps 34 are arranged at constant intervals in the transport direction of the recording medium 12. The flash lamps 34 are controlled to be turned on or off by a control unit and intermittently emit light at intervals of constant time.

A reflecting plate 36 shaped to surround a back surface side of the four flash lamps 34 and to have an opening on a front surface side (transport side), and reflecting the flash light emitted toward the back surface side from the flash lamps 34 in the transport side is provided on the back surface side of the flash lamps 34 relative to the transport path of the recording medium 12. The shape and the like of the reflecting plate 36 are adjusted so that the flash light emitted to the recording medium 12 has an almost uniform light quantity (=energy) almost over an entire surface of an irradiation range when the flash light is emitted from the four flash lamps 34. Further, a cover glass 38 is attached to the reflecting plate 36 so as to close the opening of the reflecting plate 36. This cover glass 38 prevents entry of dust and the like into the flash fixing unit 32. It is to be noted that the flash fixing unit 32 corresponds to a flash fixing component according to the invention.

Figure 4A:
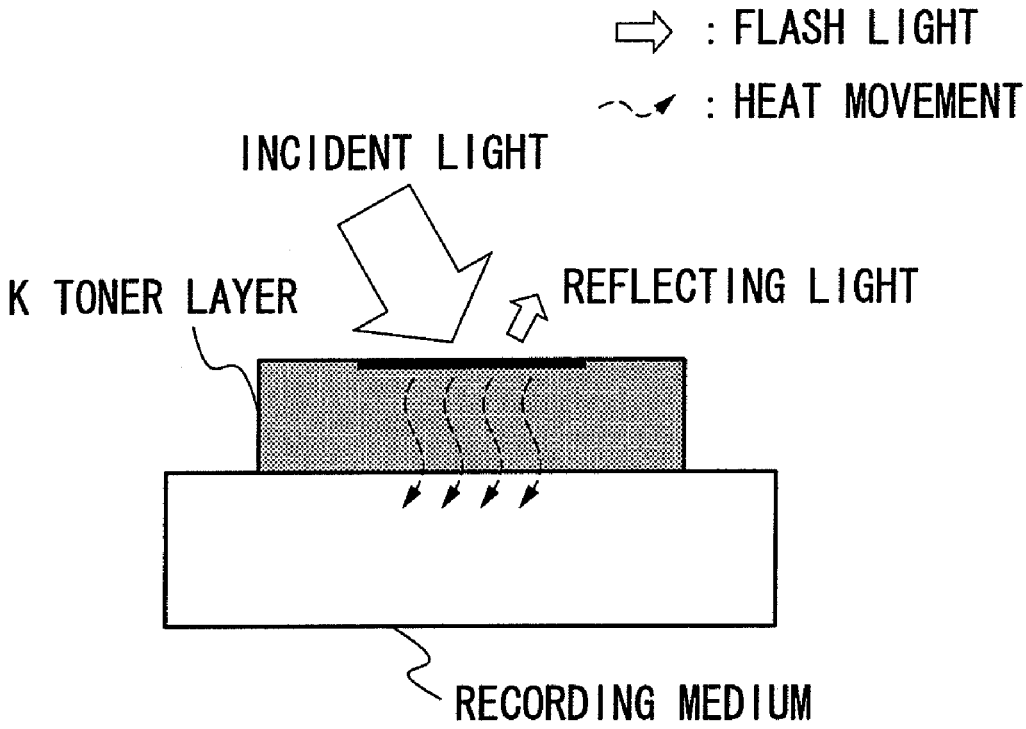
FIGS. 4A to 4D are image diagrams for explaining functions of the exemplary embodiment of the invention.
Figure 4B:
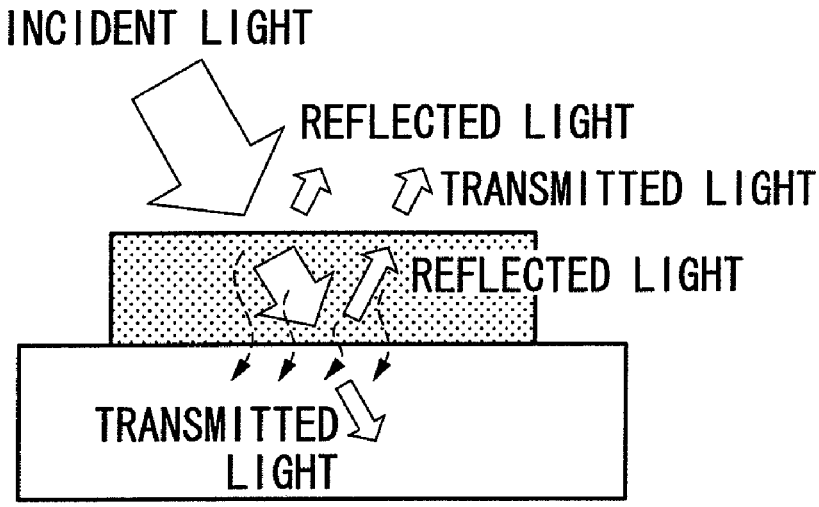

Functions of the exemplary embodiment of the invention will next be described. FIGS. 4A and 4B show a state of a region where a toner layer constituted by a K toner is formed and a state of a region where a toner layer constituted by a toner (one of C, M, and Y toners) other than the K toner is formed if a conventional color image forming apparatus emits a flash light onto the recording medium 12 onto which color toner images are formed and transferred, respectively.

Normally, the K toner has quite a high absorbance of 90% or more. If the flash light is emitted onto the region where the toner layer constituted by the K toner is formed, the flash light reflected by a surface of the toner layer is quite little (about several percentages) as shown in FIG. 4A. Most of the emitted flash light is absorbed by the surface (uppermost layer) of the toner layer and converted into heat energy, and the heat energy is conducted to the lower layer-side toner, thereby melting each of the toners and fixing the toner image. Accordingly, the toner layer constituted by the K toner has problems that surface temperature greatly rises when the flash light is emitted, and the toner sublimation and smoke is generated to follow the great rise in the surface temperature. Furthermore, heat energy is transmitted to the lower layer-side toner at low speed by heat conduction. Due to this, right after the irradiation of the flash light, the temperature difference between the upper layer-side toner and the lower layer-side toner is great and voids may possibly occur.

Meanwhile, the toners other than the K toner are lower in absorbance than the K toner. Due to this, if a flash light is emitted onto the region where the toner layer constituted by the toner other than the K toner is formed, then the emitted flash light is transmitted into the toner layer, absorbed by the toner in respective layers of the toner layer little by little, and converted into heat energy as shown in FIG. 4B. A part of the flash light arriving at an upper surface of the recording medium 12 is transmitted by the recording medium 12 and the remainder thereof is reflected by the upper surface of the recording medium 12 and transmitted again into the toner layer. In this way, in the toner layer constituted by the toner other than the K toner, the flash light transmitted into the toner layer is gradually absorbed by the toner and converted into the heat energy, resulting in generation of heat from the entire toner layer. Accordingly, the toner layers constituted by the toners other than the K toner have a problem that the toners are insufficiently melted and tend to suffer a fixing defect although the toners less sublimation, smoke is not generated from the toners, and voids are more difficult to generate than the toner layer constituted by the K toner.

This problem has been partly solved by improving an infrared absorbent added to the respective toners other than the K toner but not completely solved yet. Moreover, since the toner layers of the respective colors are laminated in the color image, it is necessary to increase the quantity of emitted flash light to fix the toner layers of the respective colors. However it is difficult to set the quantity of emitted flash light differently among portions of the recording medium 12 (portions of the image) in the flash fixing. Particularly if a color-monochrome mixture image is to be fixed by the flash fixing, there is no avoiding setting the quantity of emitted flash light to a value enough to fix a color image part. Due to this, excessive energy is applied to the K toner in the monochrome image part to follow the irradiation of the flash light, with the result that problems occur that the toner sublimations, smoke is generated from the toner, and voids are conspicuously generated.

Figure 2:
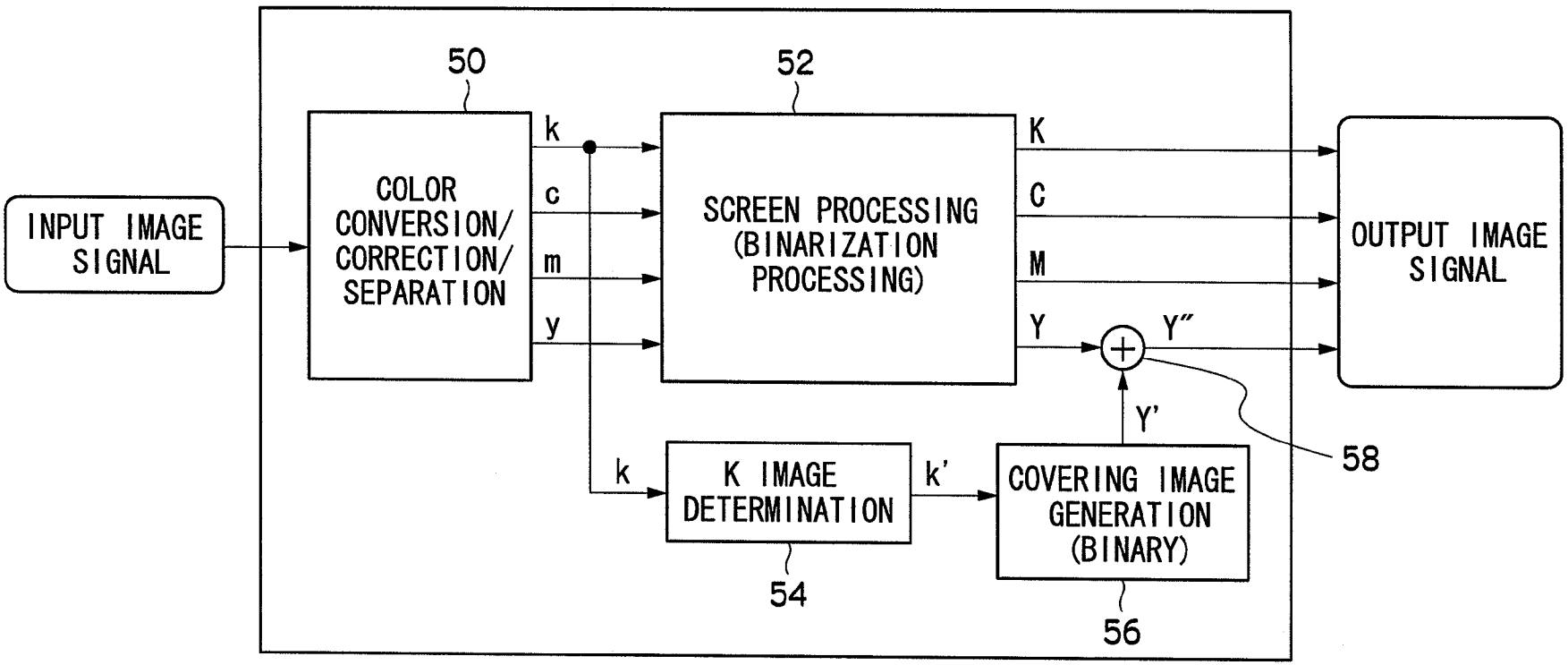
FIG. 2 is a functional block diagram showing an image processing unit while dividing the image processing unit into functional blocks for explaining an image forming control processing performed by the image processing unit.

Therefore, according to the exemplary embodiment of the invention, an image forming control program is installed in a nonvolatile storage unit of the image processing unit 40 in advance (which program corresponds to an image forming control program according to the invention). If an image signal representing an image to be recorded on the recording medium 12 is input to the image processing unit 40, the CPU included in the image processing unit 40 executes the image forming control program, whereby the image processing unit 40 performs an image forming control processing. This image forming control processing will be described with reference to the functional blocks shown in FIG. 2. It is to be noted that the control processing unit 40 performing the image forming control processing to be described below corresponds to a control component according to the invention.

The image forming control processing is a processing for generating image data to be output to the image forming units 14K, 14C, 14M, and 14Y, respectively from the input image signal. A color conversion/correction/color separation unit 50 performs a color conversion and correction processing on the input image signal and performs a color separation processing for converting the input image signal into image data of respective colors of C, M, Y, and K. If the input image signal is image data of R, G, and B, the color conversion and correction processing is performed using a DLUT (multidimensional lookup table) to which conversion conditions of integrating first, second, third conversion are set. Namely, the first conversion is to convert, for example, R, G, and B image data into data L,a,b in L*a*b color space. The second conversion is to convert the data L,a,b obtained by the first conversion into data L",a",b" coincident in brightness range to a color reproduction region of the image forming apparatus 10 (a range of colors reproducible by the image forming apparatus 10 in the L*a*b color space). The third conversion is to convert the data L",a",b" obtained by the second conversion into C, M, and Y image data. A processing for converting the input R Q and B image data into the C, M, and Y image data using the DLUT (processing for performing an integral conversion processing of the first to third conversion as one conversion processing) can be applied to the color conversion and correction processing performed by the color conversion/correction/color separation unit 50.

Further, a UCR (Under Color Removal) processing for converting the C, M, and Y image data obtained by the color conversion and correction processing into the C, M, Y, and K image data using a one-dimensional LUT (lookup table), for example, is applicable to the color separation processing performed by the color conversion/correction/color separation unit 50. By using the same conversion conditions as those integrated with a TRC (Tone Reproduction) processing for correcting gradation characteristics of the image data according to toner characteristics and the like of the image forming apparatus 10, the color conversion/correction/color separation unit 50 can perform the UCR processing and the TRC processing simultaneously.

The image data of the C, M, Y, and K ("c, m, y, and k" in FIG. 2) obtained by the respective processings performed by the color conversion/correction/color separation unit 50 are input to a screen processing unit 52, respectively. The screen processing unit 52 performs a screen processing on the input image data of the C, M, K, and Y, respectively, thereby generating and outputting binary image data of C, M, Y, and K ("C, M, Y, and K" in FIG. 2). In the conventional image forming apparatus, the binary image data of the C, M, Y, and K obtained by the screen processing is output to the image forming units 14K, 14C, 14M, and 14Y as they are to be used for image forming in the image forming units 14K, 14C, 14M, and 14Y, respectively. According to the exemplary embodiment of the invention, by contrast, the image processing unit 40 includes a K image determination unit 54, a covering image generation unit 56, and a Y image combining unit 58 so as to prevent excessive energy from being applied to the K toner to follow irradiation of the flash light.

Namely, according to the exemplary embodiment of the invention, the K image data ("k") output from the color conversion/correction/separation unit 50 is also input to the K image determination unit 54. First, the K image determination unit 54 extracts regions (K image regions) where the toner layer constituted by the K toner is formed from the image represented by the K image data output from the color conversion/correction/separation unit 50 based on the input K image data. Next, the K image determination unit 54 extracts from the extracted K image region a region in which the K image region is continuous along an x direction on the image (e.g., a direction corresponding to the width direction of the recording medium 12) by a predetermined length (e.g., about 1 millimeter (mm) on the image) or more and in which the K image region is continuous along a y direction on the image (e.g., a direction orthogonal to the x direction) by the predetermined length (e.g., about 1 mm on the image) or more as a K image region to which the Y toner is to adhere.

Figure 3:
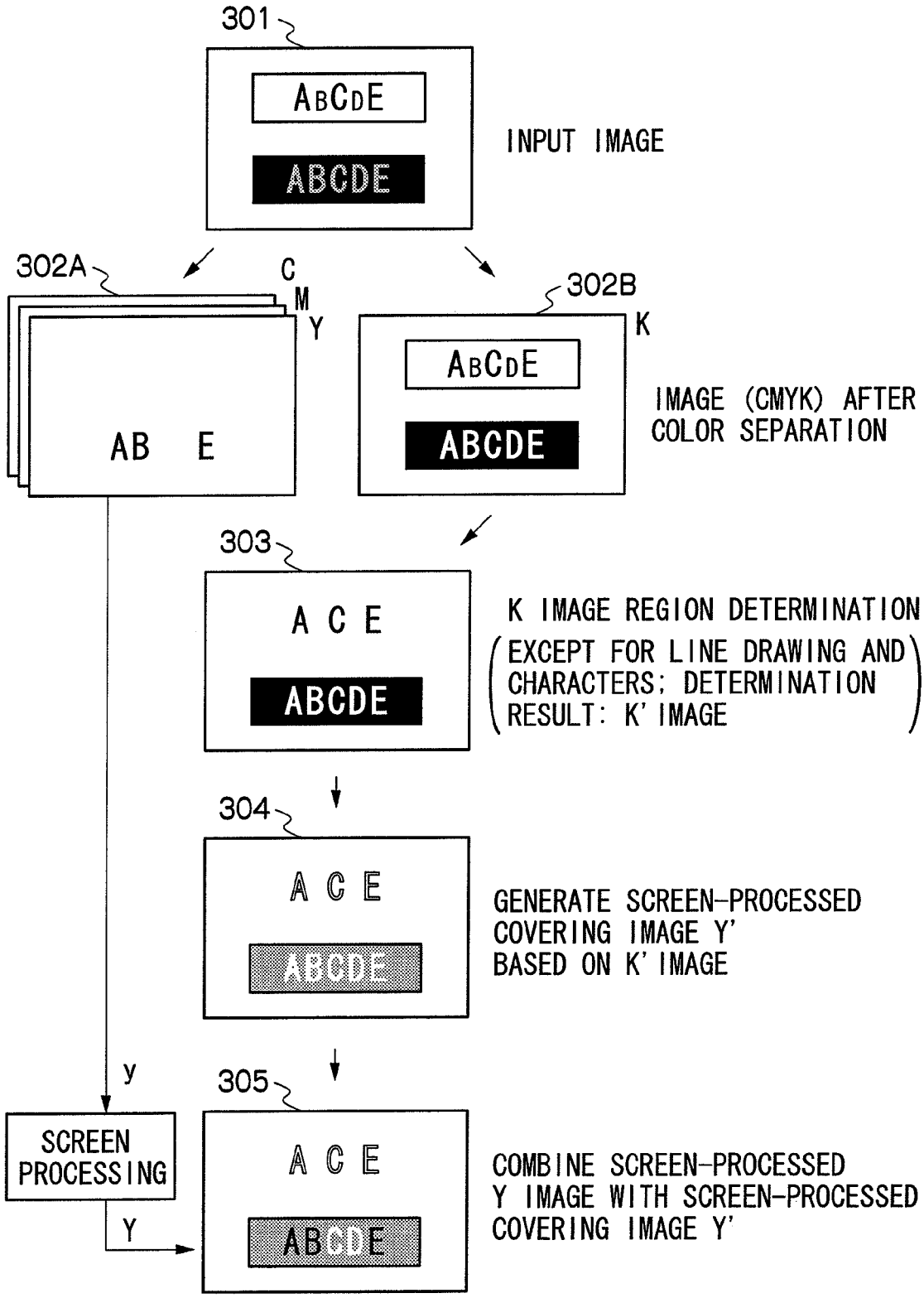
FIG. 3 is an image diagram for explaining output image data generation by the image forming control processing.

In this way, the color conversion/correction/separation unit 50 performs the color conversion and correction processing and the color separation processing on the input image represented by the input image signal, for example, an image 301 in FIG. 3, thereby obtaining the image data representing the C, M, Y, and K images 302A and 302B. The K image determination unit 54 extracts a region in of which the K image region is continuous in the x and y direction each by the predetermined length or more from the K image data 302B. As evident from comparison of a K' image 303 with the K image 302B shown in FIG. 3, the K image determination unit 54 extracts a region in which a thin line (a rectangular thin line surrounding a character string "$A_BC_DE$" in the K image 302B in FIG. 3) and thin characters ("$_B$" and "$_D$" in the character string "$A_BC_DE$" in the K image 302B in FIG. 3) are removed as the Y toner adhesion target K image region. The K image determination unit 54 outputs the result of extracting the Y toner adhesion target K image region to the covering image generation unit 56 as K' image data (indicating that a K density of each pixel in the Y toner adhesion target K image region is higher than 0(>0) and that K densities of the other pixels are 0(=0). It is to be noted that the K image determination unit 54 corresponds to a K image determination component.

The covering image generation unit 56 converts K densities of the pixels in the K' image data input from the K image determination unit 54 into covering Y densities according to the K densities of the pixels according to the following Table 1.

TABLE 1

Set values of covering Y densities relative to K densities

| | Covering Y density (%) | | |
|---|---|---|---|
| K density (%) | Weak | Normal | Strong |
| 100 | 12 | 20 | 20 |
| 90 | 10 | 15 | 20 |
| 80 | 6 | 11 | 15 |
| 70 | 5 | 10 | 12 |
| 60 | 5 | 7 | 11 |
| 50 | 4 | 5 | 9 |
| 0-40 | 0 | 0 | 0 |

In the Table 1, three levels of "strong", "normal", "weak" are set as intensities of the covering Y density relative to the K density. The covering image generation unit 56 converts the K density of each pixel in the K' image data into a covering Y density corresponding to a preset intensity. Further, as clear from the Table 1, whichever the intensity of the covering Y density out of the three levels, if the K density is equal to or lower than 40%, then the covering Y density is 0%, and pixels at K density of 40% or less among the pixels in the Y toner adhesion target K image region are excluded from the Y toner adhesion target. The covering image generation unit 56 performs a screen processing on the K' image data obtained by converting the K densities of the respective pixels into the covered Y densities, thereby generating Y binary image data ("Y'" in FIG. 2). As a result, in the example of FIG. 3, for example, the screen-processed covering image Y' 304 in FIG. 3 is obtained from the K' image 303 in FIG. 3. In the covering image Y' obtained by the screen processing, since the number of pixels to which the Y toner adheres (an area of the region to which the Y toner adheres) is larger if the covering Y density is higher, the covering Y density corresponds to an adhesion density of a second color toner.

The Y binary image data (image data representing the screen-processed covering image Y') generated by the covering image generation unit 56 is output to the Y image combining unit 58. Y binary image data Y output from the screen processing unit 52 is also input to the Y image combining unit 58. The Y image combining unit 58 combines the Y binary image data Y input from the screen processing unit 52 with the Y binary image data Y' input from the covering image generation unit 56, thereby generating new binary image data of Y (denoted by "Y"" in FIG. 2). In this way, in the example of FIG. 3, the screen-processed covering image Y' 304 in FIG. 3 is combined with the Y image 302A in FIG. 3, thereby obtaining the binary image data representing the covering output image Y" 304 in FIG. 3. The binary image data is output to the image forming unit 14Y. The covering image generation unit 56 and the Y image combining unit 58 correspond to a generation component.

Figure 4C:
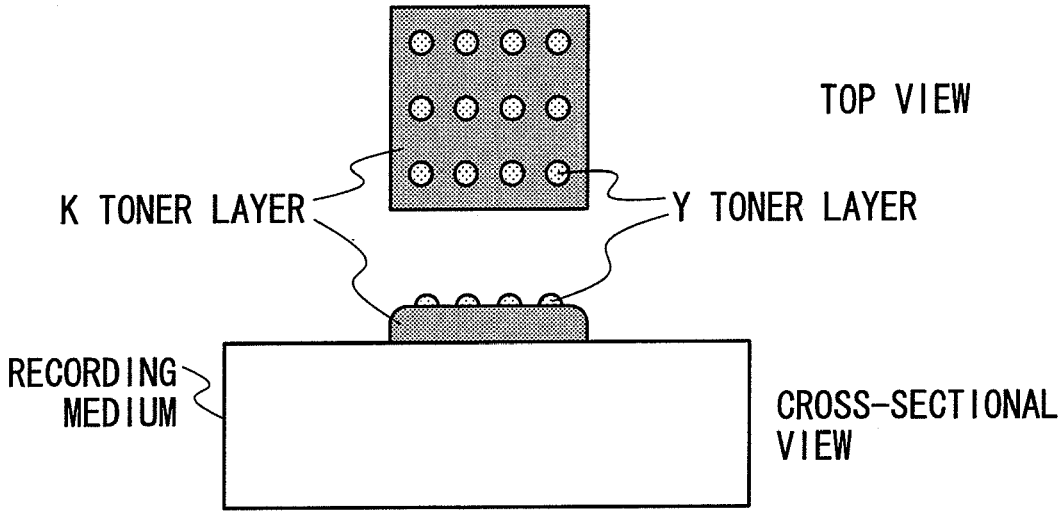

The image processing unit 40 performs the image forming control processing, thereby forming a toner layer constituted by the K toner (K toner layer) out of the color toner images transferred onto the recording medium 12. The Y toner adheres to portions where the K toner layer is continuous in both the x and y directions each by the predetermined length or more and where the K density of the K toner layer is equal to or higher than a predetermined value (e.g., 50% or more in the example of the Table 1) on a surface of the K toner layer at an adhesion density according to the K density, as shown in FIG. 4C, for example. Thus, a part of the surface of the K toner layer is covered with the Y toner.

Figure 4D:
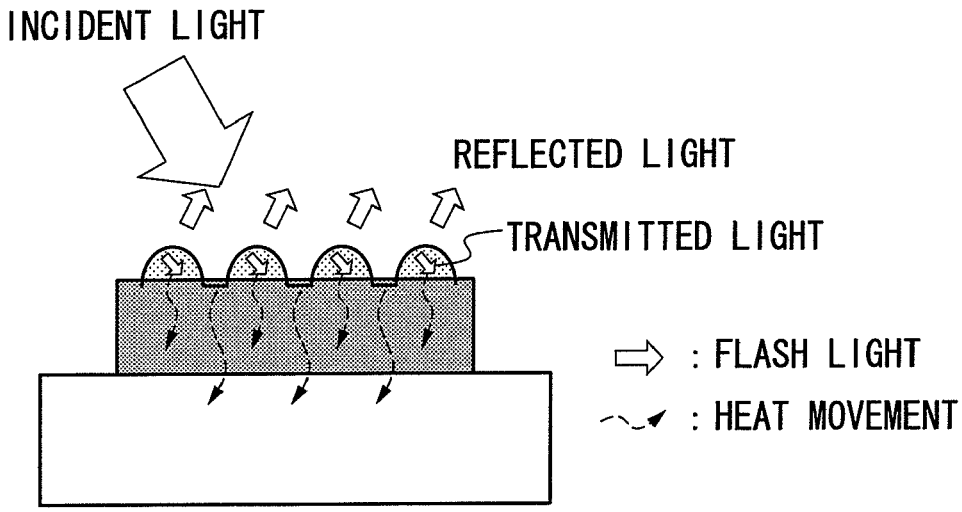

If a flash light is emitted onto the K toner layer the surface of which is covered with the Y toner, most of the flash light emitted onto portions in which the K toner layer is exposed is absorbed by the surface (uppermost layer) of the K toner layer and converted into heat energy, as shown in FIG. 4D. Further, the flash light emitted onto the portions covered with the Y toner is transmitted by the toner layer constituted by the Y toner. Since a part of the flash light is absorbed by the Y toner and converted into heat energy, the flash light is attenuated. The attenuated flash light reaches the K toner layer and is absorbed by the surface of the K toner. As compared with the instance (state shown in FIG. 4A) that the entire surface of the K toner layer is exposed, the surface temperature of the K toner layer is suppressed from rising and the temperature difference between the upper layer-side toner and the lower layer-side toner within the K toner layer is reduced at timing right after the flash light is emitted as evident from an experimental result to be described later. Therefore, it is possible to reduce toner sublimation, generation of smoke, generation of voids and the like, and to improve the quality of the image fixed onto the recording medium 12.

Moreover, by covering a part of the surface of the K toner layer with the Y toner, it is possible to reduce toner sublimation, generation of smoke, generation of voids and the like. Accordingly, the quantity of emitted flash light can be set to a value enough to fix the color image parts (parts where the toner layers of the respective colors are laminated) in the image and it is possible to ensure melting and fixing the toners in the color image parts in the image even if the image transferred onto the recording medium 12 is an image of the mixture of color and monochrome.

Furthermore, according to the exemplary embodiment of the invention, the Y toner is attached onto the surface of the K toner layer in the image (the surface of the K toner layer is covered with the Y toner) only in the regions where the K density is equal to or higher than the predetermined value. As obvious from the experimental result to be described later, it is possible to prevent the adhesion of the Y toner from being visually recognized as degradation in image quality. Besides, according to the exemplary embodiment of the invention, the Y toner is attached only onto surfaces of the regions in which the K toner layer is continuous in both the x and y directions each by the predetermined length or more (the surfaces of the regions are covered with the Y toner) among the regions in which the K toner layer is formed in the image. Therefore, even if positions at which the image forming units 14K and 14Y form the image are deviated from each other, it is possible to prevent this deviation of the image forming positions from being clearly visually recognized as the Y regions where the K thin line or the K thin characters are formed to be slightly deviated in the image.

Figure 5:
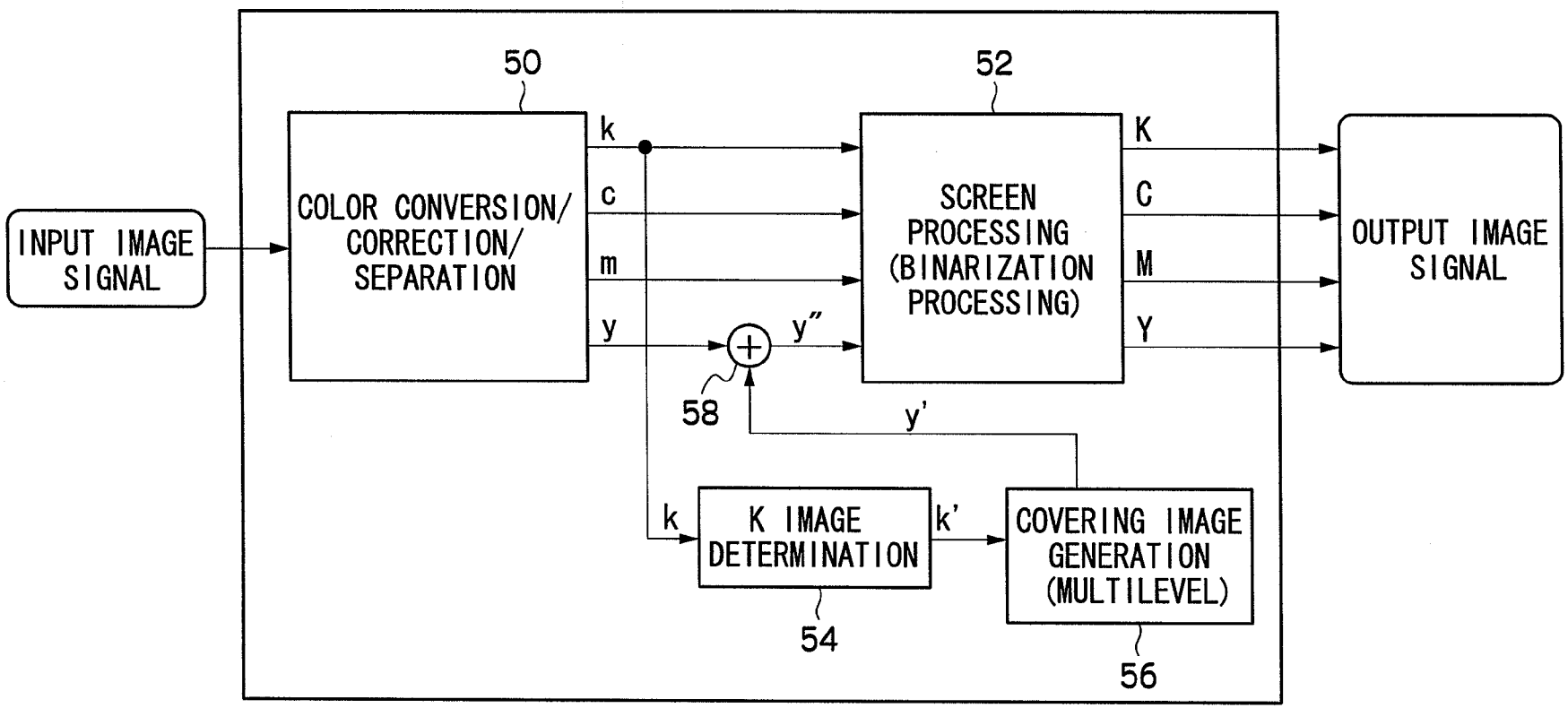
FIG. 5 is a functional block diagram for explaining another image forming control processing.

The exemplary embodiment in which two items of the screen-processed binary image data are applied as the image data for adhesion and as the second color image data, respectively and combined together, thereby generating the second color image data used to form the second color toner image has been described. However, the invention is not limited to the exemplary embodiment. Alternatively, two items of multilevel image data may be applied to the image data for adhesion and the second color image data, respectively. This alternative can be realized by, for example, as shown in FIG. 5, configuring the covering image generation unit 56 to generate and output multilevel image data Y (image data before the screen processing) representing the covering Y density of each of the pixels having the K densities equal to or higher than the predetermined value among the pixels in the Y toner adhesion target K image regions, and configuring the Y image combining unit 58 to combine multilevel image data Y' output from the covering image generation unit 56 with Y multilevel image data Y output from the color conversion/correction/separation unit 50. In this case, the Y binary image data to be output to the image forming unit 14Y can be obtained by one screen processing performed by the screen processing unit 52, thereby advantageously simplifying the processing. The alternative shown in FIG. 5 exhibit almost the same advantages as those of the exemplary embodiment shown in FIG. 2, i.e., it is possible to sublime the toner and reduce generation of the smoke, generation of voids and the like.

Furthermore, the instance in which the three levels of "strong", "normal", and "weak"are set as the intensity levels of the covering Y density has been described. However, the invention is not limited to the instance. More intensity levels of the covering Y density may be set or the number of intensity levels of the covering Y density may be set to 2 or 1 (the covering Y density corresponding to a certain K density may be fixed).

The instance in which the regions in which the K toner layer is continuous both in the x and y directions each by the predetermined length or more and where the K density is equal to or higher than the predetermined value are extracted from the regions (K image regions) where the K toner layer is formed as the regions where the Y toner adheres to the K toner layer has been described. However, the invention is not limited to the instance. Alternatively, the regions where the K toner layer is continuous both in the x and y directions each by the predetermined length or more and where the K density is equal to or higher than the predetermined value may be extracted as the regions where the Y toner adheres to the K toner layer only from the regions where the K toner layer is formed and no layers other than the K toner layer are formed (K regions in the monochrome image parts).

Moreover, the instance in which Y is applied as the second color according to the invention. However, the invention is not limited to the instance. Since each of the C and M toners is lower in absorbance than the K toner, the C or M may be applied as the second color according to the invention or a combination of a plurality of colors from among the C, M, and Y may be applied as the second color according to the invention. Nevertheless, the Y toner is the lowest in absorbance among the C, M, and Y toners, it is preferable to use at least the Y as the second color according to the invention. Besides, if an image is to be formed using a color toner other than the C, M, Y, and K toners, at least the toner lowest in absorbance among all the toners is preferably used as the second color according to the invention.

The instance of applying the K toner as the first color according to the invention has been described. However, the invention is not limited to the instance. Alternatively, if toner sublimation, generation of smoke, generation of voids and the like occur even to a C toner layer or an M toner layer to follow irradiation of the flash light, the C or M as well as the K may be applied as the first color according to the invention and the Y toner (or the color toner lower in absorbance than the C toner and the M toner) may adhere onto the surface of the C toner layer or the M toner layer.

The instance in which the image forming control program according to the invention is stored (installed) in the nonvolatile storage unit of the image processing unit 40 in advance has been described. Alternatively, the image forming control program can be provided in the form of being recorded on a recording medium such as a CD-ROM or a DVD-ROM.

EXAMPLES

The result of experiments conducted by the inventors of the present invention to confirm the advantages of the invention will be described.

In a first experiment conducted by the inventors of the invention, the image forming apparatus 10 described in the exemplary embodiment was used to examine a change in the surface temperature of the K toner layer by adhesion of the Y toner onto the surface of the K toner layer. Assuming that the four flash lamps 34 of the flash fixing unit 32 were denoted by L1, L2, L3, and L4 in order from downstream of the transport direction of the recording medium 12, the four flash lamps 34 were turned on to emit light at one millisecond's intervals in order of L2→L3→L1→L4. This flash light was emitted onto a recording medium on which only the K toner layer at a K density of 100% was formed (recording medium on which the entire surface of the K toner layer is exposed) and onto a recording medium on which the K toner layer at a K density of 100% was formed and the K toner layer was covered with the Y toner at a covering Y density of 20% (recording medium on which a part of the surface of the K toner layer was covered with the Y toner), respectively. A surface temperature T1 of the K toner and an interface temperature T2 between the K toner layer and the recording medium were calculated for each of the two recording mediums by a simulation.

Figure 6A:
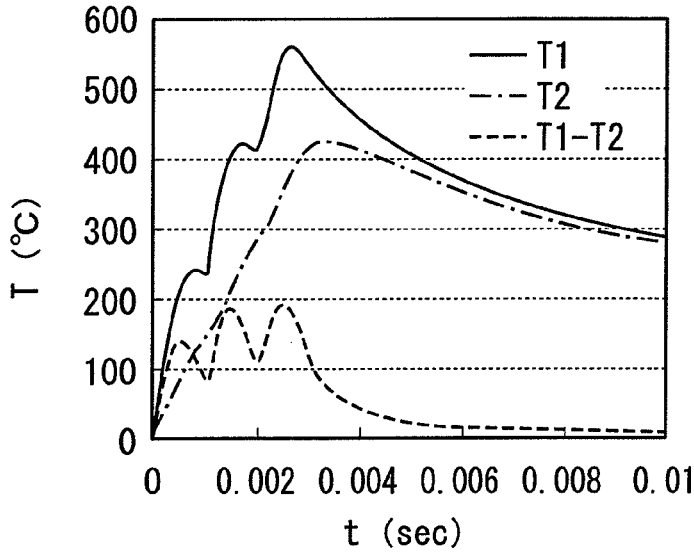
FIGS. 6A to 6C are charts showing results of experiments conducted by the inventors of the present application.
Figure 6B:
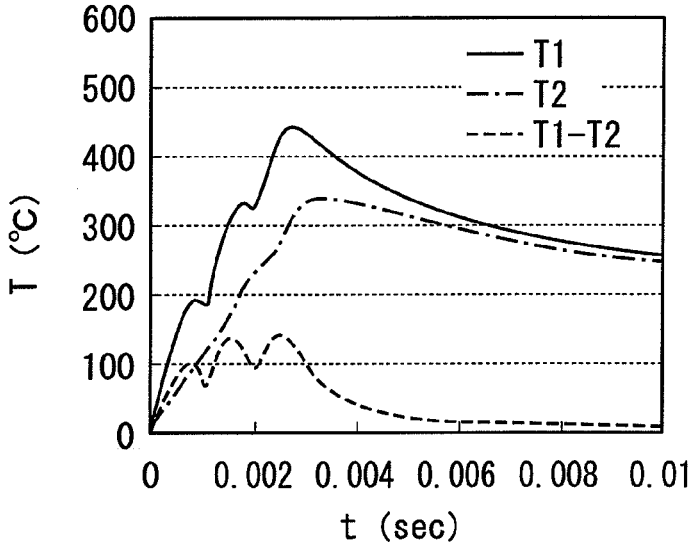

FIG. 6A shows the temperature change of the recording medium on which the entire surface of the K toner layer is exposed. FIG. 6B shows the temperature change of the recording medium on which a part of the surface of the K toner layer is covered with the Y toner. As evident from comparison between FIGS. 6A and 6B, it was confirmed that the peak of the surface temperature T1 of the K toner layer changed from about 560° C. to about 450° C. and that the toner sublimation and generation of smoke could be greatly reduced by covering a part of the surface of the K toner layer with the Y toner. Further, the peak of the surface temperature (T1-T2) between the surface temperature T1 of the K toner layer and the interface temperature T2 was reduced from about 190° C. to about 150° C. Therefore, it was confirmed that voids could be reduced by covering a part of the surface of the K toner layer with the Y toner.

In a second experiment conducted by the inventors of the invention, the effect and adverse effect of covering a part of the surface of the K toner layer with the Y toner were examined and an optimum covering Y density for the density of the K toner was calculated. The effect was evaluated based on the temperature of the K toner layer that causes the toner sublimation, the generation of smoke, and the generation of voids. The adverse effect was evaluated by measuring a change in the color of the K image region by covering a part of the surface of the K toner layer with the Y toner and based on subjective evaluations of persons being tested.

Figure 6C:
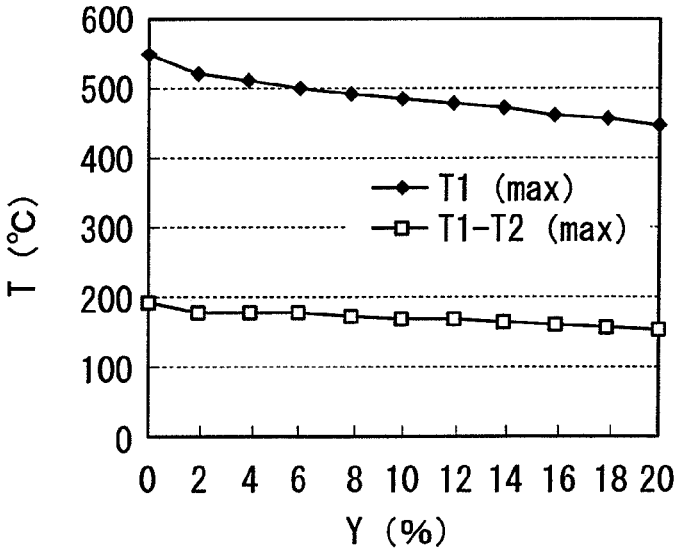

FIG. 6C shows the surface temperature T1 of the K toner layer relative to the change in the covering Y density and the change in the peak of the temperature difference (T1-T2) between the surface temperature T1 and the interface temperature T2 if a part of the surface of the K toner layer at the K density of 100% is covered with the Y toner. As obvious from FIG. 6C, the surface temperature T1 of the K toner layer and the peak of the temperature difference (T1-T2) both decreased if the covering Y density rose, and it was confirmed that the effect of reducing the toner sublimation, the generation of smoke, and the generation of voids increased if the covering Y density rose.

Figure 7A:
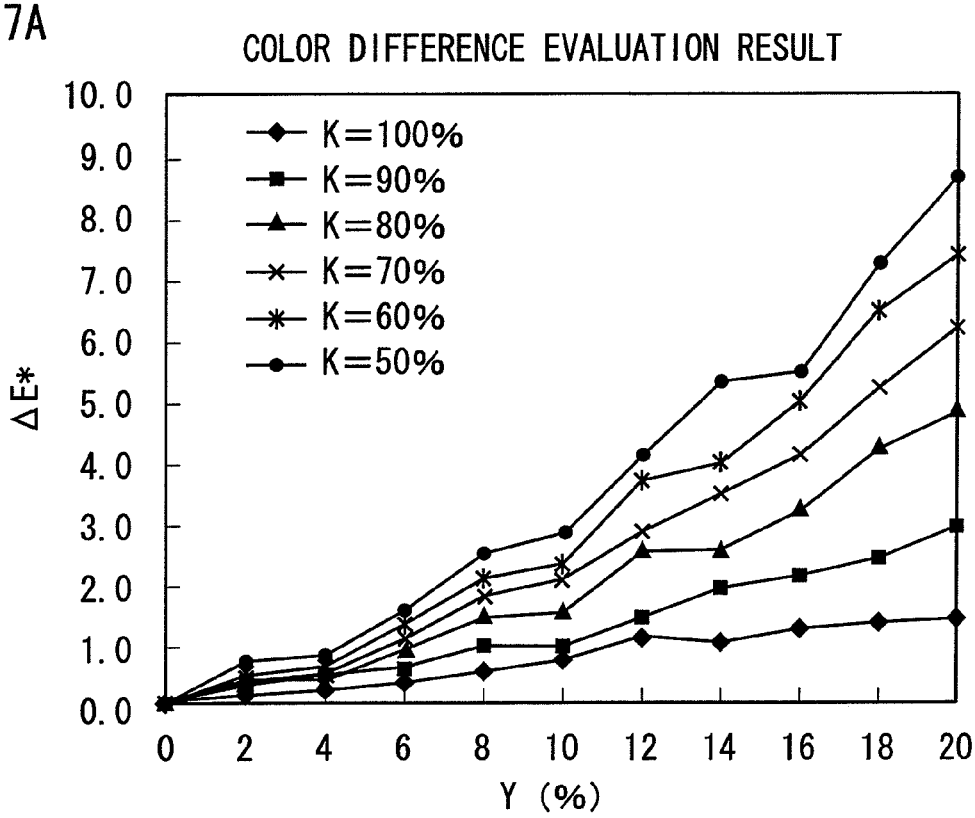
FIGS. 7A and 7B are charts showing results of experiments conducted by the inventors of the application.
Figure 7B:
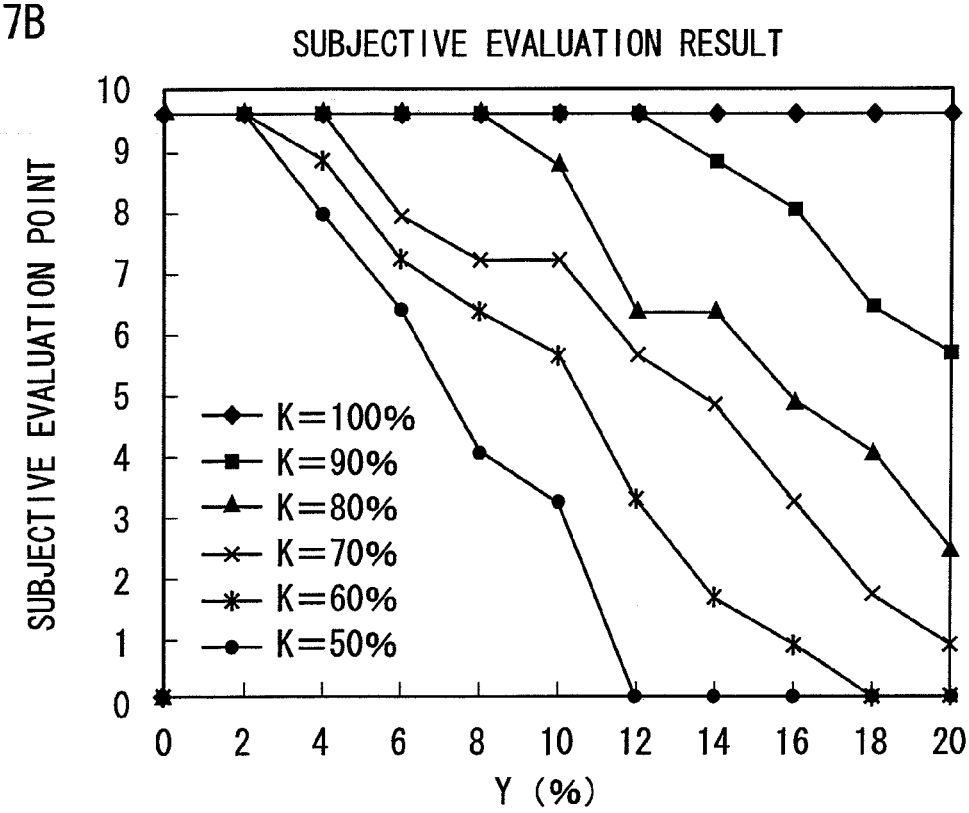

To check the upper limit of the covering Y density based on the experimental results, reference sample images on which the K toner layer at various K densities were generated, and colors of the generated reference sample images were measured using a color measuring tool, respectively. Further, sample images which were generated similarly to the reference sample images, i.e., on which the K toner layers at various K densities are formed and on which the toner layers were covered with the Y toner at various covering Y densities were created, and colors of the generated reference sample images were measured using the color measuring tool, respectively. Color differences $\Delta E^*$ between the sample images and the reference sample images were measured, thereby checking changes in color difference $\Delta E^*$ relative to the change in the covering Y density for the K densities of the K toner layer, respectively. FIG. 7A shows the result. FIG. 7B shows a result of evaluating color changes of the sample images (images each covered the Y toner) relative to the reference sample images by subjective evaluation points in the range of 11 levels that "not concerned about color change (10)" to "concerned about color change to some extent (5)" to "concerned about color change (0)" based on evaluations made by six persons being tested. FIG. 7B shows a result of averaging the subjective evaluation points.

As clear from the results shown in FIGS. 7A and 7B, if the K density is high, the subjective evaluation points were "not concerned about color change (10)" or near "not concerned about color change (10)" and the actual color difference $\Delta E^*$ is small even with the high covering Y density. If the K density is low, the subjective evaluation points near "concerned about color change (0)" even if the covering Y density is relatively low and the actual color difference $\Delta E^*$ is small. In relation to the set values of the covering Y densities shown in the Table 1 shown above, acceptable levels are color difference $\Delta E^* \leqq 2.0$ and the subjective evaluation point $\geqq 7$, if the intensity of the covering Y density is "normal", those are the color difference $\Delta E^* \leqq 1.0$ and the subjective evaluation point $\geqq 8$, if the intensity of the covering Y density is "weak", and those are the color difference $\Delta E^* \leqq 3.0$ and the subjective evaluation point $\geqq 6$, if the intensity of the covering Y density is "strong" based on the experimental results.

As can be seen, by using these set values of the covering Y densities, the covering Y densities can be set to able to reduce the toner sublimation, the generation of smoke, and the generation of voids, and the covering Y density can be set to suppress the color change of the K image so that a user is not concerned about the color change of the K image due to covering of the surface of the K toner layer with the Y toner. Moreover, by adjusting the intensity of the covering Y density according to various conditions including the amount of emitted flash light and the average K density in the K image region in the image, it is possible to realize both reduction in the toner sublimation, the generation of smoke, and the generation of voids and suppression of the color change of the K image despite various conditions.

What is claimed is:

1. An image forming apparatus, comprising:

an image forming component that forms toner images using at least two toners respectively having different colors and transfers the formed toner images onto a recording medium;

a flash fixing component that emits a flash light onto the recording medium onto which the toner images have been transferred by the image forming component and fixes the toner images; and a control component that controls the image forming component to form the toner images so that, among the toner images, a second color toner is adhered to a surface of a toner layer formed by a first toner color at a region at which the toner layer formed by the first toner color is formed, the absorbance of the second color toner being lower than that of the first color toner, wherein the control component is configured to control the adhering of the second color toner at the region on the basis that the density of the toner layer where the first color toner is formed exceeds a predetermined value or on the basis that the area of continuous coverage of the first color toner in the region exceeds a predetermined area, wherein the control component controls the image forming component to form the toner images such that, on the toner images, the second color toner is adhered to the surface of the toner layer only at a portion having an area that is continuous by at least a predetermined length in a first direction and in a second direction intersecting with the first direction in the region at which the toner layer formed by the first color toner is formed.

2. The image forming apparatus of claim 1, wherein:

the at least two toners having different colors used by the image forming component to form the toner images include a K toner; and the first color toner is the K toner.

3. The image forming apparatus of claim 1, wherein:

the image forming component can form color toner images using toners including at least a C toner, an M toner, a Y toner and a K toner; and the second color toner includes at least the Y toner.

4. The image forming apparatus of claim 1, wherein:

the control component controls the image forming component to form the toner images such that the adhesion density at which the second color toner adheres to the surface of the toner layer formed by the first toner color in respective portions of the region at which the toner layer formed by the first toner color is formed, changes according to the density of the color in the respective portions of the region.

5. The image forming apparatus of claim 1, wherein:

the image forming component forms a color toner image by forming toner images in different colors including at least C, M, Y and K using toners of the respective colors based on image data for the respective colors, and by overlapping the toner images formed in the respective colors;

the control component includes:

a K color image determination component that identifies a portion, on the toner images, of the region at which the toner layer formed by the first color toner is formed, in the color toner image formed by the image forming component, that is continuous by at least a predetermined length in a first direction and in a second direction intersecting with the first direction based on the image data of the K toner as the first color, and that determines a K color density of respective parts of the identified portion; and a generation component that generates second color image data used for forming a second color toner image by the image forming component, by generating image data for adhesion for adhering the second color toner with an adhesion density corresponding to the K color density in respective parts of the surface of the toner layer, for each part within the portion identified by the K color image determination component, based on the determination result by the K color image determination component, and by synthesizing the generated image data for adhesion with the second color image data.

6. An image forming method comprising:

(a) forming toner images using at least two toners respectively having different colors, and transferring the formed toner images onto a recording medium;

(b) fixing the toner images by emitting a flash light onto the recording medium onto which the toner images have been transferred in (a); and (c) controlling the formation of the toner images in (a) so that, among the toner images formed in (a), a second color toner is adhered to a surface of a toner layer formed by a first color toner in a region at which the toner layer is formed by the first color toner, the absorbance of the second color toner being lower than that of the first color toner, wherein the control component is configured to control the adhering of the second color toner at the region on the basis that the density of the toner layer where the first color toner is formed exceeds a predetermined value or on the basis that the area of continuous coverage of the first color toner in the region exceeds a predetermined area, wherein the forming of toner images in (a) is controlled so that, on the toner images, the second color toner is adhered to the surface of the toner layer only at a portion having an area that is continuous by at least a predetermined length in a first direction and in a second direction intersecting with the first direction in the region at which the toner layer formed by the first color toner is formed.

7. The image forming method of claim 6, wherein the at least two toners having different colors used in (a) to form the toner images include a K toner, and the first color toner is the K toner.

8. The image forming method of claim 6, wherein in (a), color toner images can be formed using toners including at least a C toner, an M toner, a Y toner and a K toner, and the second color toner includes at least the Y toner.

9. The image forming method of claim 6, wherein the forming of toner images in (a) is controlled so that the adhesion density at which the second color toner adheres to the surface of the toner layer formed by the first color toner in respective portions of the region at which the toner layer formed by the first color toner is formed, changes according to the density of the first color in the respective portions of the region.

10. The image forming method of claim 6, wherein in the forming of toner images in (a), a color toner image is formed by forming toner images in different colors including at least C, M, Y and K using toners of the respective colors based on image data the respective colors, and by overlapping the toner images formed in the respective colors, and the image forming method further comprising:

(d) identifying a portion, on the toner images, of the region at which the toner layer formed by the first color toner is formed, in the color toner image formed in (a), that is continuous by at least a predetermined length in a first direction and in a second direction intersecting with the first direction based on the image data of the K toner as the first color, and determining a K color density of respective parts of the identified portion; and (e) generating second color image data used for forming a second color toner image in (a), by generating image data for adhesion for adhering the second color toner with an adhesion density corresponding to the K color density in respective parts of the surface of the toner layer, for each part within the portion identified in (d), based on the determination result in (d), and by synthesizing the generated image data for adhesion with the second color image data.

11. A storage medium readable by a computer, the storage medium storing a program of instructions executable by the computer to perform a function for image formation, the function comprising:

(a) forming toner images using at least two toners respectively having different colors, and transferring the formed toner images onto a recording medium;

(b) fixing the toner images by emitting a flash light onto the recording medium onto which the toner images have been transferred in (a); and (c) controlling the formation of the toner images in (a) so that, among the toner images formed in (a), a second color toner is adhered to a surface of a toner layer formed by a first color toner in a region at which the toner layer is formed by the first color toner, the absorbance of the second color toner being lower than that of the first color toner, wherein the control component is configured to control the adhering of the second color toner at the region on the basis that the density of the toner layer where the first color toner is formed exceeds a predetermined value or on the basis that the area of continuous coverage of the first color toner in the region exceeds a predetermined area, wherein the forming of toner images in (a) is controlled so that, on the toner images, the second color toner is adhered to the surface of the toner layer only at a portion having an area that is continuous by at least a predetermined length in a first direction and in a second direction intersecting with the first direction in the region at which the toner layer formed by the first color toner is formed.

12. The storage medium of claim 11, wherein the at least two toners having different colors used in (a) to form the toner images include a K toner, and the first color toner is the K toner.

13. The storage medium of claim 11, wherein in (a), color toner images can be formed using toners including at least a C toner, an M toner, a Y toner and a K toner, and the second color toner includes at least the Y toner.

14. The storage medium of claim 11, wherein the forming of toner images in (a) is controlled so that the adhesion density at which the second color toner adheres to the surface of the toner layer formed by the first color toner in respective portions of the region at which the toner layer formed by the first color toner is formed, changes according to the density of the first color in the respective portions of the region.

15. The storage medium of claim 11, wherein in the forming of toner images in (a), a color toner image is formed by forming toner images in different colors including at least C, M, Y and K using toners of the respective colors based on image data the respective colors, and by overlapping the toner images formed in the respective colors, and the function further comprising:

(d) identifying a portion, on the toner images, of the region at which the toner layer formed by the first color toner is formed, in the color toner image formed in (a), that is continuous by at least a predetermined length in a first direction and in a second direction intersecting with the first direction based on the image data of the K toner as the first color, and determining a K color density of respective parts of the identified portion; and (e) generating second color image data used for forming a second color toner image in (a), by generating image data for adhesion for adhering the second color toner with an adhesion density corresponding to the K color density in respective parts of the surface of the toner layer, for each part within the portion identified in (d), based on the determination result in (d), and by synthesizing the generated image data for adhesion with the second color image data.

* * * * *